US006260780B1

(12) United States Patent
Kroger et al.

(10) Patent No.: US 6,260,780 B1
(45) Date of Patent: Jul. 17, 2001

(54) PAPER SHREDDER SHAFT

(75) Inventors: Bruce R. Kroger, West Chicago; Raymond R. Ferriss, Schaumburg, both of IL (US)

(73) Assignee: Fellowes Manufacturing Company, Itasca, IL (US)

( * ) Notice: Subject to any disclaimer, the term of this patent is extended or adjusted under 35 U.S.C. 154(b) by 0 days.

(21) Appl. No.: 09/384,308

(22) Filed: Aug. 26, 1999

(51) Int. Cl.[7] ..... B02C 18/06; B02C 18/16
(52) U.S. Cl. ..... 241/236; 241/291; 241/293
(58) Field of Search ..... 241/100, 236, 241/291, 293, 294, 295

(56) References Cited

U.S. PATENT DOCUMENTS

| | | | | |
|---|---|---|---|---|
| 93,668 | | 8/1869 | Brasitt et al. . | |
| 664,001 | | 12/1900 | Nisbett et al. . | |
| 1,825,223 | | 9/1931 | Deck . | |
| 1,939,246 | | 12/1933 | Antonsen | 92/20 |
| 2,815,077 | | 12/1957 | Pechy | 164/60 |
| 3,333,752 | | 8/1967 | Vincens | 225/97 |
| 3,730,043 | | 5/1973 | Zimmerman | 83/502 |
| 3,746,267 | | 7/1973 | Myers et al. | 241/46.11 |
| 3,768,712 | | 10/1973 | Imbert | 225/3 |
| 4,194,698 | * | 3/1980 | Kosmowski | 241/236 |
| 4,333,612 | | 6/1982 | Hayashi | 241/33 |
| 4,422,581 | | 12/1983 | Chryst | 241/66 |
| 4,869,435 | | 9/1989 | Pistorius et al. | 241/100 |
| 4,959,986 | | 10/1990 | Kranis, Sr. | 72/129 |
| 5,048,767 | | 9/1991 | Mori | 241/236 |
| 5,054,351 | | 10/1991 | Jolliffe et al. | 83/430 |
| 5,071,080 | | 12/1991 | Herbst et al. | 241/166 |
| 5,152,206 | | 10/1992 | Mulling | 83/425.3 |
| 5,295,633 | | 3/1994 | Kimbro et al. | 241/166 |
| 5,676,321 | | 10/1997 | Kroger | 241/236 |
| 5,683,045 | | 11/1997 | Staniszewski | 241/236 |
| 5,799,887 | | 9/1998 | Kroger | 241/236 |
| 5,988,542 | * | 11/1999 | Henreckson et al. | 241/100 |
| 6,089,482 | * | 7/2000 | Chang | 241/236 |

FOREIGN PATENT DOCUMENTS

| | | |
|---|---|---|
| 222515 | 12/1973 | (DE) . |
| 761607 | 11/1956 | (GB) . |

* cited by examiner

*Primary Examiner*—John M. Husar
(74) *Attorney, Agent, or Firm*—Brinks Hofer Gilson & Lione

(57) ABSTRACT

A shredder cylinder that includes a generally circular shaft having a plurality of spaced apart cutting disks arranged along the axis of the cylinder, and a spacer disposed between adjacent disks. The spacer has a diameter greater than the diameter of the shaft and smaller than the diameter of the cutting disks, and a spacer surface wherein the peripheral cross-section of the surface of the spacer has a linear measure greater than the measure of the distance between two disks adjacent the spacer.

12 Claims, 2 Drawing Sheets

PAPER SHREDDER SHAFT

BACKGROUND OF THE INVENTION

The present invention relates to a cross cutting cylinder for shredding paper. In particular, the present invention relates to a novel shaft or cylinder useful for cross-cut type shredders.

In order to destroy documents to preserve their confidentiality, shredders exist which cut or tear the paper into narrow strips or chips. Typically, the cutting is achieved by a pair of rotating cutting cylinders having a series of circular cutters or blades arranged along the axis of a solid shaft.

The cutters on one rotating cylinder are offset to that the cutters pass between the cutters of the other rotating cylinder.

The actual structure of the rotating cylinders having cutters can be a solid bar of steel or similar material in which cutters and spacers are formed by machining so that the cutters and spacers are all integral to one another. Another structure has separate cylindrical members of a large diameter, which are used as the cutters and are spaced apart by separate cylindrical spacers, which are assembled on a shaft in an alternating relationship.

Generally, there are two types of shredder assemblies, a straight or strip cut, and a cross-cut. A straight cut shredder cuts the paper into long, thin strips. This result may be undesirable because it may be possible to reassemble the long thin strips to form the original documents. Another problem with these types of shredders is that after paper has been cut into strips, the strips tend to wind around the cutters and spacers, clogging the cutting area, and if not prevented, eventually causing the mechanism to be jammed.

A cross cut shredder generally comprises a pair of parallel cutting cylinders that contain a series of offset cutting disks arranged along the axis of the cylinders. Cross cut shredders produce small paper chips. Unfortunately, the shredded chips tend to follow the direction of the cutting cylinders and may eventually clog the cutting mechanism.

To solve this problem, it has been suggested to provide strippers to strip away the shredded paper. Typically, strippers consist of a serrated member or a comb type member having teeth that protrude into the spaces between the individual cutting disks. These strippers are generally located on the outward or post-cutting side of the cutting mechanism. Although strippers help to reduce the clogging that may be experienced by cutting cylinders, there is still room for improvement.

Accordingly, it is an object of the present invention to provide a cross cut shredder for a paper shredder that is an improvement over the prior art shredders.

It is a further object of the present invention to provide a crosscut shredder where any paper chips falling into the space between the cutting blades are dislodged, thereby preventing clogging of the shredder.

It is yet another object of the present invention to provide a crosscut shredder that has few parts and is easy to assemble.

SUMMARY OF THE INVENTION

The present invention provides a shredder cylinder that includes a generally circular shaft having a plurality of spaced apart cutting disks arranged along the axis of the cylinder. A spacer may be disposed between adjacent disks. Generally, a spacer is provided between each adjacent disks.

The spacer has a diameter greater than the diameter of the shaft and smaller than the diameter of the cutting disks. In addition, the spacer has a surface such that the peripheral cross-section of the surface of the spacer has a linear measure greater than the linear measure of the distance between the two disks adjacent the spacer.

In one embodiment, the peripheral cross-section of the spacer surface comprises a depression consisting of a V-shaped notch. In another embodiment, the peripheral cross-section of the spacer surface comprises a V-shaped bump or protuberance.

DETAILED DESCRIPTION OF THE INVENTION

Figure 1:
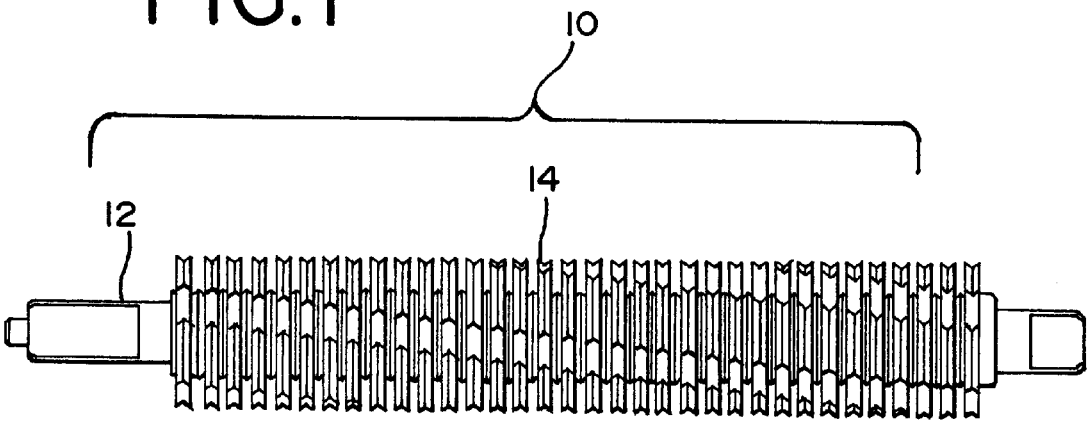
FIG. 1 is a front elevational view of a cutting cylinder according to the present invention.
Figure 2:
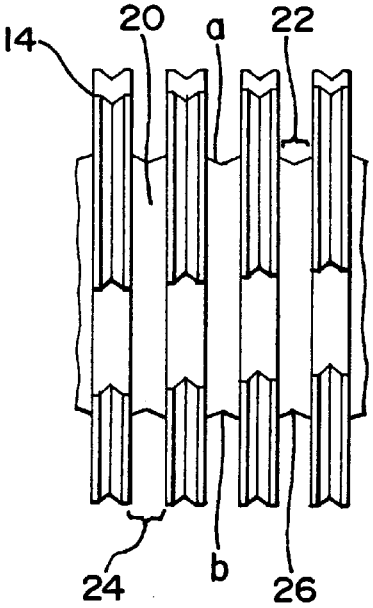
FIG. 2 is a partial front view of a cutting cylinder according to an embodiment of the invention.
Figure 3:
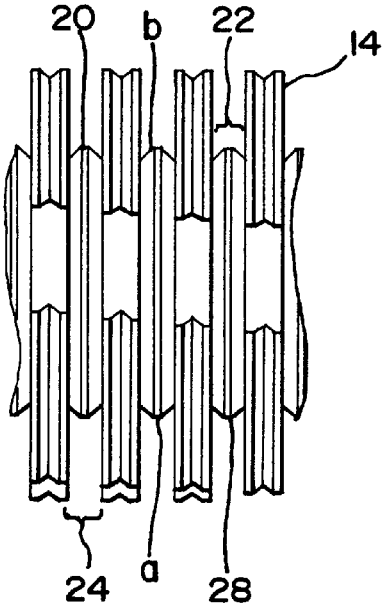
FIG. 3 is a partial front view of a cutting cylinder according to another embodiment of the invention.

Turning now to FIG. 1, a cutting cylinder according to the present invention is shown. The cylinder 10 includes a shaft 12 having at least two, and preferably a plurality of, spaced apart cutting disks 14.

As is known in the art, cutting disks for cross-cut shredders generally have one or more teeth and when the disks are arranged on the cutting cylinder shaft a large pitch helix is evident. The helix may be provided by machining, where the cutting cylinder is machined. Alternately, the helix may be provided by staggering adjacent cutting disks along the length of the cutting cylinder. The cutting disk 14 is cylindrical and may include one or more circumferentially spaced teeth 16 (best seen in FIG. 4). The particular construction and shape of the teeth is not important to the practice of the present invention so long as they provide a cross cut (i.e. chips of material). Therefore, the cutting the disks may have the construction and shape shown and described in U.S. Pat. Nos. 5,676,321 and 5,295,633, each of which is incorporated herein by reference. A preferred construction provides teeth that do not protrude past the perimeter of the disk. Each tooth 16, has a cutting edge 18 that is tapered on the top and angled, providing a sharp surface which can easily penetrate the material that is to be shredded. Preferably, the cutting edge 18 of each tooth is tapered and angled in the same direction as the cutting edges 18 of the other teeth 16.

Figure 4:
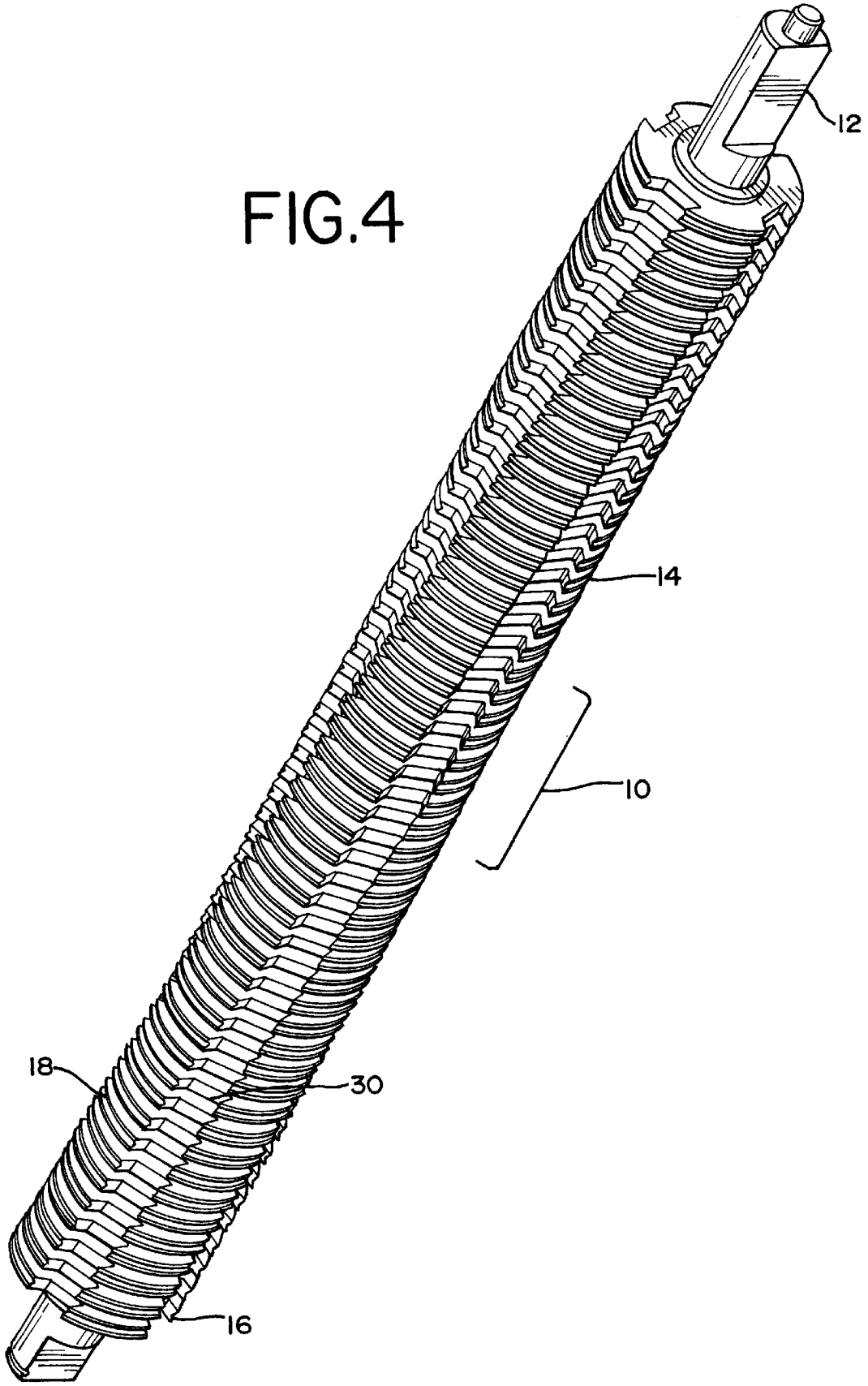
FIG. 4 is an exploded view of a cutting cylinder containing a cutting disk.

As shown in FIG. 4, the individual cutting disks 14 or their teeth 16 are somewhat displaced in the longitudinal direction of the cutting cylinder 10 so that a large pitch helix 30 is formed.

Disposed between adjacent disks 14 is a spacer 20 located adjacent to each disk 14. The size of the spacer 20 is not critical, but the spacer 20 must have a width slightly greater than an individual disk 14. When two cylinders are positioned to form a dual cylinder-shredding machine, the disks 14 are arranged in an interleaving pattern. Thus, the disks 14 on one cylinder are positioned so that a disk 14 from one cylinder fits within the space between two adjacent disks.

Preferably, the spacer 20 is integral with the body of the disk. Alternately, the spacer 20 may be a separate component that provides distance between individual disks 14 on the cutting cylinder 10. In yet another embodiment, the entire cutting cylinder may be machined as a single piece so that the shaft, disks and spacers are formed from and are a single piece. If the spacer 20 is a separate component, it is preferably attached or affixed to the body of the disk 14 or the shaft. Any method of attachment presently known in the art is appropriate.

The spacer 20 is preferably substantially circular and has a diameter greater than that of the shaft 12 and smaller than that of the disks 14. The circumference of the spacer 20 has a surface 22 wherein the linear measure of the surface 22 is greater than the linear distance between two adjacent disks 24. It will be appreciated that the circumference of the spacer 20 at at least one point a is greater than the circumference of the spacer 20 at at least another different point b. In one embodiment, the circumference of spacer at its center is greater than the circumference of the spacer at at least one of its edges, and preferably both. In another embodiment, the circumferences of the spacer at its center is less than the circumference of the spacer at at least one of its edges, and preferably both. In yet another embodiment, the circumference of the spacer at one edge is greater than the circumference of the spacer at its other edge. It should be understood that the spacer 20 described above can be changed in many ways yet still remain within the scope of the invention. The peripheral cross-section of the spacer 20 may be any shape. For instance, the peripheral cross-section of the spacer 20 may consist of a depression, a notch, a rounded notch, an annular groove, a V-shaped groove, an incline on one side, an inverted V-shape, an inverted arcuate V-shape, or an inverted U-shape and the like. In one embodiment, the peripheral cross-section of the spacer 20 comprises a V-shaped notch 26 formed between two disks 14. In the preferred embodiment, the peripheral cross-section of the spacer 20 comprises an inverted V-shape 28.

The shredder cylinder of the present invention provides many advantages. It creates small paper chips but prevents and/or reduces clogging in the area between adjacent disks.

Of course, it should be understood that a wide range of changes and modifications can be made to the preferred embodiment described above. It is therefore intended that the foregoing description illustrates rather than limits this invention, and that it is the following claims, including all equivalents that define this invention.

What is claimed is:

1. A cutting cylinder comprising a shaft having at least two spaced apart cutting disks each having at least two circumferentially spaced teeth and a spacer located between two adjacent disks wherein the cutting disks are displaced in the longitudinal direction of the cutting cylinder, and the surface of the spacer has a linear measure greater than the distance between the two adjacent disks.

2. The cutting cylinder of claim 1 wherein the peripheral cross-section of the spacer consists of a shape selected from the group consisting of a depression, a notch, a rounded notch, an annular groove, a V-shaped groove, an incline on one side, an inverted V-shape, an inverted arcuate V-shape, and an inverted U-shape.

3. The cutting cylinder of claim 2 wherein the peripheral cross-section of the surface of the spacer consists of a V-shaped notch.

4. The cutting cylinder of claim 2 wherein the peripheral cross-section of the surface of the spacer consists of an inverted V-shape.

5. The cutting cylinder of claim 1 wherein the circumference of the spacer at at least one point is greater than the circumference of the spacer at at least one other point.

6. The cutting cylinder of claim 5 wherein the circumference of the spacer at its center is greater than the circumference of the spacer at at least one of its edges.

7. The cutting cylinder of claim 5 wherein the circumference of the spacer at its center is less than the circumference of the spacer at at least one of its edges.

8. The cutting cylinder of claim 5 wherein the circumference of the spacer at a first edge of the spacer is less than the circumference of the spacer at a second edge of the spacer.

9. The cutting cylinder of claim 1 wherein a spacer is located between each adjacent disk and wherein the surface of each spacer has a linear measure greater than the distance between each adjacent disk.

10. The cutting cylinder of claim 1 wherein the at least two cutting disks are arranged to provide a helix.

11. The cutting cylinder of claim 10 wherein the cutting disks are staggered along the longitudinal direction of the cylinder.

12. A cross-cut cutting cylinder comprising:

a. a plurality of cutting disks with each disk having at least two circumferentially spaced teeth, with the disks arranged in a longitudinal direction of the cutting cylinder to provide a helix; and, b. a spacer located between each adjacent disk, wherein a surface of the spacer has a linear measure greater than the distance between each adjacent disk.

* * * * *

Disclaimer

6,260,780—Bruce R. Kroger, West Chicago; Raymond R. Ferriss, Schaumburg, both of IL (US). PATENT SHREDDER SHAFT. Patent dated Jul. 17, 2001. Disclaimer filed Aug. 26,1999 by the assignee, Fellowes, Inc.

Hereby enters this disclaimer to claims 1, 2, 5, 7, 9, 10, and 12 of said patent.

*(Official Gazette October 16, 2007)*

US006260780C1

(12) EX PARTE REEXAMINATION CERTIFICATE (6357th)

United States Patent

Kroger et al.

(10) Number: US 6,260,780 C1

(45) Certificate Issued: Aug. 12, 2008

(54) PAPER SHREDDER SHAFT

(75) Inventors: Bruce R. Kroger, West Chicago, IL (US); Raymond R. Ferriss, Schaumburg, IL (US)

(73) Assignee: Fellowes, Inc., Itasca, IL (US)

Reexamination Request:
No. 90/008,456, Jan. 30, 2007

Reexamination Certificate for:

| | |
|---|---|
| Patent No.: | **6,260,780** |
| Issued: | **Jul. 17, 2001** |
| Appl. No.: | **09/384,308** |
| Filed: | **Aug. 26, 1999** |

(51) Int. Cl.

| | |
|---|---|
| ***B02C 18/06*** | (2006.01) |
| ***B02C 18/16*** | (2006.01) |
| ***B02C 1/10*** | (2006.01) |

(52) U.S. Cl. ..... 241/236; 241/291; 241/293

(58) Field of Classification Search ..... None
See application file for complete search history.

(56) References Cited

U.S. PATENT DOCUMENTS

| | | | |
|---|---|---|---|
| 1,525,590 | A | 2/1925 | Perrault |
| 1,825,223 | A | 9/1931 | Deck |
| 3,312,794 | A | 4/1967 | Hollyday |
| 3,619,537 | A | 11/1971 | Nara et al. |
| 3,724,766 | A | 4/1973 | Bosland |
| 3,764,819 | A | 10/1973 | Muller |
| 3,829,850 | A | 8/1974 | Guetersloh |
| 3,860,180 | A | 1/1975 | Goldhammer |
| 3,869,238 | A | 3/1975 | Racca |
| 3,947,734 | A | 3/1976 | Fyler |
| 3,991,944 | A | 11/1976 | Baikoff |
| 4,018,392 | A | 4/1977 | Wagner |
| 4,044,532 | A | 8/1977 | Lessig, III |
| 4,068,805 | A | 1/1978 | Oswald |
| 4,082,232 | A | 4/1978 | Brewer |
| 4,125,228 | A | 11/1978 | Brewer |
| 4,172,400 | A | 10/1979 | Brierley |
| 4,187,420 | A | 2/1980 | Piber |
| 4,194,698 | A | 3/1980 | Kosmowski |
| 4,352,980 | A | 10/1982 | Hibari |

(Continued)

FOREIGN PATENT DOCUMENTS

| | | |
|---|---|---|
| CN | 99208833 | 1/2000 |
| CN | 99213588.5 | 6/2000 |
| DE | 222515 | 5/1910 |
| DE | 32 08 676 | 10/1982 |
| DE | 32 47 299 | 7/1984 |
| DE | 33 13 232 | 10/1984 |
| DE | 35 40 896 | 5/1987 |
| DE | 78 18 838 | 6/1987 |
| DE | 37 33 413 | 4/1988 |
| DE | 86 19 856.4 | 10/1988 |

(Continued)

OTHER PUBLICATIONS

International Search Report for PCT/US2005/011312, Jul. 26, 2005, 11 pages.

Markman Decision from Eastern District of Virginia, *Fellowes, Inc.* v. *Michilin Prosperity Company, Ltd. and Intek America, Inc.*, Civil Action No. 2:06cv289, Dec. 15, 2006, 39 pages.

(Continued)

*Primary Examiner*—Jeffrey R Jastrzab

(57) ABSTRACT

A shredder cylinder that includes a generally circular shaft having a plurality of spaced apart cutting disks arranged along the axis of the cylinder, and a spacer disposed between adjacent disks. The spacer has a diameter greater than the diameter of the shaft and smaller than the diameter of the cutting disks, and a spacer surface wherein the peripheral cross-section of the surface of the spacer has a linear measure greater than the measure of the distance between two disks adjacent the spacer.

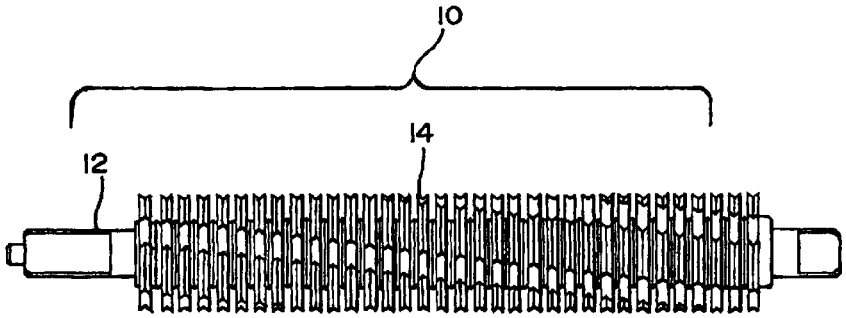

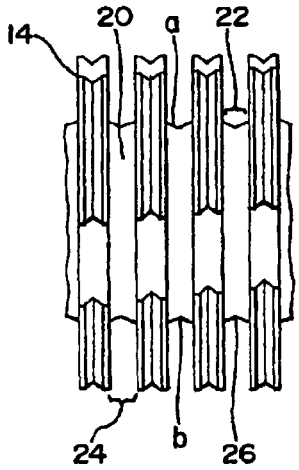

U.S. PATENT DOCUMENTS

| | | | |
|---|---|---|---|
| 4,420,863 | A | 12/1983 | Trimmer et al. |
| 4,471,915 | A | 9/1984 | Levin et al. |
| 4,562,971 | A | 1/1986 | Schwelling |
| 4,673,136 | A | 6/1987 | Bianco et al. |
| 4,683,381 | A | 7/1987 | Dufoug |
| 4,693,428 | A | 9/1987 | Raterman et al. |
| 4,713,509 | A | 12/1987 | Chebowski |
| 4,767,895 | A | 8/1988 | Parrish |
| 4,784,601 | A | 11/1988 | Nitta |
| 4,784,602 | A | 11/1988 | Nitta |
| 4,821,967 | A | 4/1989 | Moriyama |
| 4,839,533 | A | 6/1989 | Aga |
| 4,859,172 | A | 8/1989 | Nitta |
| 4,882,458 | A | 11/1989 | Berg et al. |
| 4,910,365 | A | 3/1990 | Kuo |
| 4,944,462 | A | 7/1990 | Raterman et al. |
| 5,045,648 | A | 9/1991 | Fogleman, Sr. |
| 5,065,947 | A | 11/1991 | Farnsworth |
| 5,081,406 | A | 1/1992 | Hughes et al. |
| 5,100,067 | A | 3/1992 | Konig et al. |
| 5,135,178 | A | 8/1992 | Strohmeyer |
| 5,166,406 | A | 11/1992 | Challenger |
| 5,166,679 | A | 11/1992 | Vranish et al. |
| 5,171,143 | A | 12/1992 | Sohn |
| 5,186,398 | A | 2/1993 | Vigneau, Jr. |
| 5,207,392 | A | 5/1993 | Stangenberg et al. |
| 5,268,553 | A | 12/1993 | Shimoji |
| 5,275,342 | A | 1/1994 | Galanty |
| 5,279,467 | A | 1/1994 | Lydy |
| 5,295,633 | A | 3/1994 | Kimbro et al. |
| 5,345,138 | A | 9/1994 | Mukaidono et al. |
| 5,356,286 | A | 10/1994 | Sher |
| 5,397,890 | A | 3/1995 | Schueler et al. |
| 5,407,346 | A | 4/1995 | Sher |
| 5,421,720 | A | 6/1995 | Sher |
| 5,432,308 | A | 7/1995 | Howie, Jr. |
| 5,460,516 | A | 10/1995 | Sher |
| 5,494,229 | A | 2/1996 | Rokos |
| 5,568,895 | A | 10/1996 | Webb |
| 5,607,295 | A | 3/1997 | Khemarangsan |
| 5,636,801 | A | 6/1997 | Kroger |
| 5,655,725 | A | 8/1997 | Kroger |
| 5,676,321 | A | 10/1997 | Kroger |
| 5,680,999 | A | 10/1997 | Wada |
| 5,704,776 | A | 1/1998 | Sher |
| 5,724,737 | A | 3/1998 | Stones |
| D393,607 | S | 4/1998 | Dandurand |
| 5,775,605 | A | 7/1998 | Tsai |
| 5,788,476 | A | 8/1998 | Sher |
| 5,829,697 | A | 11/1998 | Kroger |
| 5,829,963 | A | 11/1998 | Ichikawa |
| 5,850,342 | A | 12/1998 | Nakamura et al. |
| 5,868,242 | A | 2/1999 | Hall et al. |
| 5,884,855 | A | 3/1999 | Chang |
| RE36,250 | E | 7/1999 | Hess |
| D412,716 | S | 8/1999 | Kroger |
| 5,942,975 | A | 8/1999 | Sorenson |
| 5,988,542 | A | 11/1999 | Henreckson et al. |
| 6,065,696 | A | 5/2000 | Tsai |
| 6,079,645 | A | 6/2000 | Henreckson et al. |
| 6,082,644 | A | 7/2000 | Turner |
| 6,089,482 | A | 7/2000 | Chang |
| 6,247,828 | B1 | 6/2001 | Herst |
| D444,809 | S | 7/2001 | Chang |
| 6,260,780 | B1 | 7/2001 | Kroger et al. |
| 6,265,682 | B1 | 7/2001 | Lee |
| 6,274,828 | B1 | 8/2001 | Chu |
| 6,308,904 | B1 | 10/2001 | Chang |
| 6,325,309 | B1 | 12/2001 | Chang |
| 6,376,939 | B1 | 4/2002 | Suzuki et al. |
| 6,392,170 | B1 | 5/2002 | Wechsler |
| 6,418,004 | B1 | 7/2002 | Mather et al. |
| 6,550,701 | B1 | 4/2003 | Chang |
| 6,575,285 | B2 | 6/2003 | Jong |
| D481,416 | S | 10/2003 | Chang |
| 6,655,943 | B1 | 12/2003 | Peterson et al. |
| 6,676,050 | B2 | 1/2004 | Chang |
| 6,676,460 | B1 | 1/2004 | Motsenbocker |
| 6,724,324 | B1 | 4/2004 | Lambert |
| D494,607 | S | 8/2004 | Hunag |
| 6,775,018 | B1 | 8/2004 | Taniguchi |
| 6,779,747 | B2 | 8/2004 | McLean et al. |
| D502,713 | S | 3/2005 | Hunag |
| D502,714 | S | 3/2005 | Hunag |
| 6,962,301 | B1 | 11/2005 | Chang |
| 6,966,513 | B2 | 11/2005 | Chang |
| 6,976,648 | B2 | 12/2005 | Chang |
| 6,979,813 | B2 | 12/2005 | Avril |
| 6,981,667 | B2 | 1/2006 | Hunag |
| 7,040,559 | B2 | 5/2006 | Matlin et al. |
| 7,044,410 | B2 | 5/2006 | Hunag |
| 7,048,218 | B2 | 5/2006 | Hunag |
| 7,150,422 | B2 | 12/2006 | Wang |
| 2004/0008122 | A1 | 1/2004 | Michael |
| 2004/0194594 | A1 | 10/2004 | Dils et al. |
| 2004/0226800 | A1 | 11/2004 | Pierga et al. |
| 2005/0132859 | A1 | 6/2005 | Huang |
| 2005/0157203 | A1 | 7/2005 | Nakakuki et al. |
| 2005/0166736 | A1 | 8/2005 | Gass et al. |
| 2005/0218250 | A1 | 10/2005 | Matlin et al. |
| 2005/0274834 | A1 | 12/2005 | Huang |
| 2005/0274836 | A1 | 12/2005 | Chang |
| 2006/0091247 | A1 | 5/2006 | Matlin |
| 2006/0157600 | A1 | 7/2006 | Wang |
| 2006/0169619 | A1 | 8/2006 | Wang |
| 2006/0249609 | A1 | 11/2006 | Huang |

FOREIGN PATENT DOCUMENTS

| | | |
|---|---|---|
| DE | 40 14 669 | 11/1991 |
| DE | 41 21 330 | 1/1993 |
| DE | 195 19 858 | 12/1996 |
| DE | 199 60 267 | 7/2000 |
| EP | 0 511 535 | 4/1992 |
| EP | 0 736 886 | 3/1996 |
| EP | 0 855 221 | 7/1998 |
| EP | 1 195 202 | 9/2001 |
| EP | 1 069 954 | 9/2002 |
| GB | 761607 | 6/1954 |
| GB | 2096919 | 10/1982 |
| GB | 2203063 | 10/1988 |
| GB | 2234690 | 2/1991 |
| JP | 52-11691 | 1/1977 |
| JP | 57-76734 | 5/1982 |
| JP | 04-157093 | 5/1992 |
| JP | 04-180852 | 6/1992 |
| JP | 4-110143 | 9/1992 |
| JP | H4-1101143 | 9/1992 |
| JP | 5-68906 | 3/1993 |
| JP | 5-123593 | 5/1993 |
| JP | 6-277548 | 10/1994 |
| JP | 7-136539 | 5/1995 |
| JP | 7-155629 | 6/1995 |
| JP | 7-299377 | 11/1995 |
| JP | 7-328469 | 12/1995 |
| JP | H7-328469 | 12/1995 |
| JP | 8-1026 | 1/1996 |
| JP | 6-137104 | 1/1996 |
| JP | 9-262491 | 10/1997 |
| JP | 10-34003 | 2/1998 |
| JP | 11-216383 | 8/1999 |
| JP | 2000-0346288 | 12/2000 |

| | | |
|---|---|---|
| JP | 2004-321993 | 11/2004 |
| TW | 306323 | 10/1985 |
| TW | 00139305 | 8/1990 |
| TW | 282696 | 8/1996 |
| TW | 306323 | 5/1997 |
| TW | 8431868A01 | 5/1997 |
| WO | 98/48937 | 11/1998 |
| WO | 99/52638 | 10/1999 |
| WO | 02/060588 | 8/2002 |
| WO | 2005/070553 | 8/2005 |

OTHER PUBLICATIONS

Consent Decree from *Fellowes, Inc.* v. *Michilin Prosperity Company, Ltd. and Intek America, Inc.,* Civil Action No. 2:06cv289, Jul. 2, 2007, 8 pages.

Transcript of Closing Arguments, *Fellowes, Inc.* v. *Michilin Prosperity Company, Ltd. and Intek America, Inc.,* Civil Action No. 2:06cv289, May 14, 2007, vol. 10, pp. 1435–1547.

Transcript of Trial Testimony of Lee Swanger, *Fellowes, Inc.* v. *Michilin Prosperity Company, Ltd. and Intek America, Inc.,* Civil Action No. 2:06cv289, May 11, 2007, vol. 9, pp. 1273–1434.

Transcript of Trial Testimony of Lee Swanger, *Fellowes, Inc.* v. *Michilin Prosperity Company, Ltd. and Intek America, Inc.,* Civil Action No. 2:06cv289, May 9, 2007, vol. 7, pp. 903–911.

Transcript of Trial Testimony of Bruce Kroger, *Fellowes, Inc.* v. *Michilin Prosperity Company, Ltd. and Intek America, Inc.,* Civil Action No. 2:06cv289, May 3, 2007, vol. 3, pp. 328–404.

Deposition transcript of Bruce Kroger, *Fellowes, Inc.* v. *Michilin Prosperity Company, Ltd. and Intek America, Inc.,* Civil Action No. 2:06cv289, Apr. 5, 2007, pp. 1–217 pages.

Deposition Transcript of Raymond Ferriss, *Fellowes, Inc.* v. *Michilin Prosperity Company, Ltd. and Intek America, Inc.,* Civil Action No. 2:06cv289, Apr. 21, 2007, pp. 1–150 pages.

Transcript of Trial Testimony of Lee Swanger, *Fellowes, Inc.* v. *Michilin Prosperity Company, Ltd. and Intek America, Inc.,* Civil Action No. 2:06cv289, May 8, 2007, vol. 6, pp. 799–901.

Transcript of Trial Testimony of Elliott Stern, *Fellowes, Inc.* v. *Michilin Prosperity Company, Ltd. and Intek America, Inc.,* Civil Action No. 2:06cv289, May 10, 2007, vol. 9, pp. 1180–1246.

Opinion & Order, *Fellowes, Inc.* v. *Michilin Prosperity Company, Ltd. and Intek America, Inc.,* Civil Action No. 2:06cv289, Jun. 22, 2007, pp. 1–28 pages.

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 3 is confirmed.

New claims 13–18 are added and determined to be patentable.

Claims 1, 2, 4, 5, 6, 7, 8, 9, 10, 11 and 12 were not reexamined.

Claims 1, 2, 5, 7, 9, 10 and 12 are now disclaimed.

*13. The cutting cylinder of claim 3, wherein one of the two adjacent cutting disks is integral with the spacer.*

*14. The cutting cylinder of claim 3, wherein the spacer has a width slightly greater than a width of either of the two adjacent cutting disks.*

*15. The cutting cylinder of claim 3, wherein the distance between the two adjacent disks is constant.*

*16. A shredder comprising interleaving first and second cutting cylinders, each of the first and second cutting cylinders comprising:*

*a shaft having at least two spaced apart cutting disks each having at least two circumferentially spaced teeth; and*

*a spacer located between two adjacent disks, the cutting disks being displaced in the longitudinal direction of the cutting cylinder, the surface of the spacer having a linear measure greater than the distance between the two adjacent disks, a peripheral cross-section of the spacer consisting essentially of a V-shaped notch.*

*17. The shredder of claim 16, wherein the peripheral cross-section of the surface of the spacer of each of the cutting cylinders consists of a V-shaped notch.*

*18. The shredder of claim 17, wherein:*

*one of the two adjacent cutting disks of the first cutting cylinder fits into the space between the two adjacent cutting disks of the second cutting cylinder, the spacer of the second cutting cylinder having a width just slightly larger than the one of the two adjacent cutting disks of the first cutting cylinder; and*

*one of the two adjacent cutting disks of the second cutting cylinder fits into the space between the two adjacent cutting disks of the first cutting cylinder, the spacer of the first cutting cylinder having a width just slightly larger than the one of the two adjacent cutting disks of the second cutting cylinder.*

* * * * *